United States Patent [19]

Inman

[11] Patent Number: 4,550,632

[45] Date of Patent: Nov. 5, 1985

[54] KNIFE SHARPENER

[75] Inventor: Roger Inman, Sheffield, England

[73] Assignee: Archant Limited, England

[21] Appl. No.: 546,272

[22] Filed: Oct. 28, 1983

[30] Foreign Application Priority Data

Jan. 18, 1983 [GB] United Kingdom ..... 8301312

[51] Int. Cl.[4] ..... A01D 3/00; B24B 3/36

[52] U.S. Cl. ..... 76/86; 51/285

[58] Field of Search ..... 76/86, 87, 88, 82; 51/285

[56] References Cited

U.S. PATENT DOCUMENTS

| | | | |
|---|---|---|---|
| 772,542 | 10/1904 | Sullivan | 76/86 |
| 1,041,631 | 10/1912 | Johnson | 76/86 |
| 2,124,646 | 7/1938 | Barsch | 76/86 |
| 3,064,393 | 11/1962 | Chasan | 76/86 |

*Primary Examiner*—Roscoe V. Parker

*Attorney, Agent, or Firm*—King, Liles & Schickli

[57] ABSTRACT

This disclosure relates to sharpeners for blades having a cutting edge, and is particularly concerned with knife sharpeners of the type where two sharpening elements (generally known as "steels") are located in a housing in overlapping V-formation and spring-loaded towards each other, with an access opening in the housing to allow the blade of, e.g., a knife or pair of scissors to be pressed against the steels, and when reciprocation of the blade effects sharpening of the cutting edge. Such sharpeners known hitherto, are arranged to provide a constant V-angle between the sharpening elements, and accordingly produce the same V-shaped cutting edge irrespective as to the thickness of the blade. The object is to provide a sharpener that can correctly sharpen thicker and thinner blades, which objective is met by a construction comprising two sharpening elements mounted in overlapping V-formation and spring-loaded to each other, said sharpening elements being pivotally mounted at one end such that on pivotal movement of the sharpening elements consequent upon the application of a blade between the sharpening elements, the V-angle between the elements varies dependent upon the depth of insertion of the blade.

2 Claims, 2 Drawing Figures

KNIFE SHARPENER

This invention relates to sharpeners for blades having a cutting edge, and is particularly concerned with knife sharpeners of the type where two sharpening elements (generally known as "steels") are located in a housing in overlapping V-formation and spring-loaded towards each other, with an access opening in the housing to allow the blade of, e.g., a knife or pair of scissors to be pressed against the steels, and when reciprocation of the blade effects sharpening of the cutting edge.

Whilst such sharpeners known hitherto have proved effective, they have two disadvantages, one of cost, but perhaps more importantly, the steels are mounted in the housing such that on movement of the steels away from each other when a blade is pressed against them, there is maintained a constant V-angle between the steels. Consequently, on re-sharpening a blade, a cutting edge of the angle of the Vee is produced irrespective as to the thickness of the particular blade, i.e., no account is taken of whether or not a relatively thick or relatively thin blade is being re-sharpened.

The object of the present invention is to provide a sharpener generally of the type referred to but which avoids the above referred to disadvantages.

According to the present invention, a sharpener for blades having a cutting edge comprises two sharpening elements mounted in overlapping V-formation and spring-loaded to each other, said sharpening elements being pivotally mounted at one end such that on pivotal movement of the sharpening elements consequent upon the application of a blade between the sharpening elements, the V-angle between the elements varies dependent upon the depth of insertion of the blade.

Thus, the sharpening elements may be located in a housing and each mounted on an arm and the arms pivotally mounted in the housing towards their upper ends, the arms towards their lower ends being secured to springs and whereby the arms and hence the sharpening elements are spring-loaded to each other in V-formation. Thus with the housing having an access opening for the blade, on insertion of the blade into the access opening and against the sharpening elements pressure on the blades causes the arms to pivot against the action of the springs and the greater the degree of insertion of the blade the narrower is the V-angle between the sharpening elements. From this it follows that with a thicker blade the blade is held in relation to the sharpening elements such that a larger V-angle is provided, and with a narrower blade a greater degree of insertion is effected to produce a narrower V-angle and whereby correct sharpening of the blade cutting edge can take place. Alternatively the arms on which the sharpening elements are mounted are pivotally secured in the housing towards their lower ends with again the arms secured to springs and whereby the arms and hence the sharpening elements are spring-loaded towards each other. With this construction, the greater the degree of penetration of a blade, the greater is the V-angle between the sharpening elements and hence a thicker blade would be inserted to a greater degree than a narrower blade for correct sharpening to be effected.

Preferably the two sharpening elements are of circular section and are of the form generally known as steels, and it is further preferred that each steel is mounted on its respective arm to be freely rotatable. By being freely rotatable, a sharpening action on the blade cutting edge is effected with minimal wear on both the blade and the steel.

The housing and the respective arms may both be formed from an appropriate plastics material with a consequent considerable saving on costs, and a wear insert can if necessary be provided in which the respective steel can be freely rotatably mounted, to prevent wear on the arm consequent upon rotation of the steel.

The invention therefore provides a relatively low cost highly efficient sharpener for the blades of knives, scissors and the like capable of accommodating different thicknesses of such blades requiring different V-shaped cutting edges for optimium cutting performance of such items.

One embodiment of the invention will now be described with reference to the accompanying drawings, in which.

Figure 1:
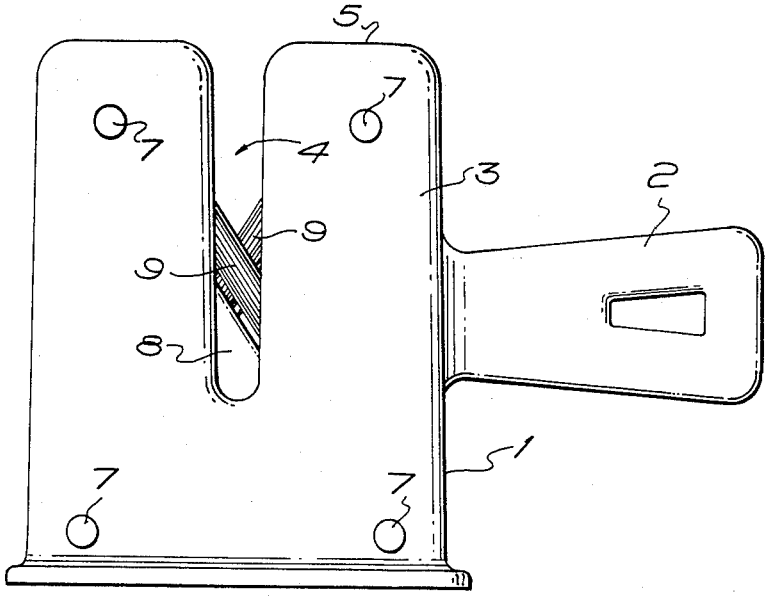
FIG. 1 is a side elevation of a sharpener according to the invention.
Figure 2:
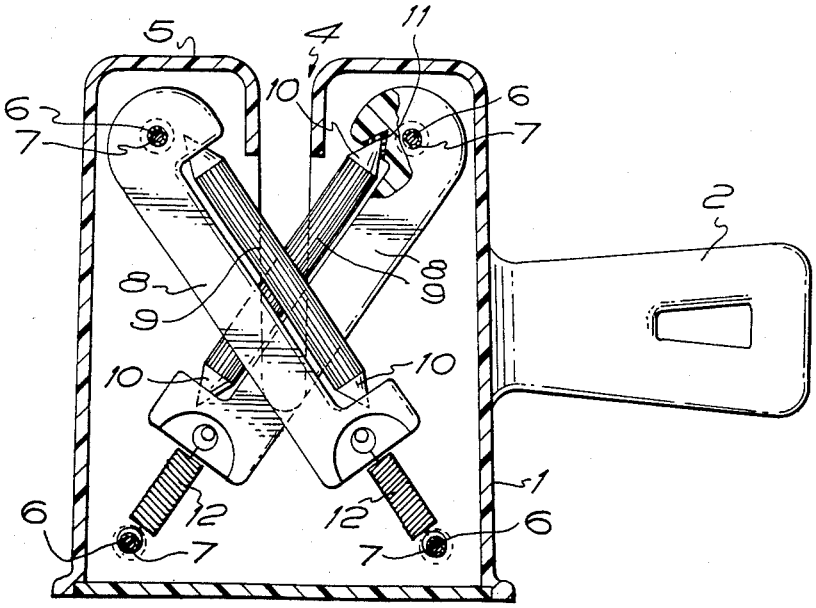
FIG. 2 is a sectional side elevation of the sharpener of FIG. 1.

In the drawings, a sharpener for blades having a cutting edge, has a housing 1 formed with an integral handle 2 and whereby the sharpener can be held stationary during the sharpening of a blade. The housing is closed at its lower end by a removable base.

The housing is formed as a hollow moulding from a suitable synthetic plastics material, each side face 3 having an access slot 4 emerging in the upper face 5. Towards each corner of the housing locating pins are provided bridging the interior of the housing, each pin being formed from a headed pin 6 and a headed sleeve 7 into which the pin is a push fit. Pivotally mounted on each pin at the upper end of the housing is an arm 8, of an appropriate synthetic plastics material, and on each arm is rotatably mounted a sharpening steel 9. Thus, each sharpening steel has each end 10 of conical shape, to locate in a corresponding conical recess at each end of the arm, which recesses each have a wear resistant lining 11.

Each arm 8 at its lower end is connected to a spring 12, which springs are in turn connected to a respective pin 6, 7 bridging the housing at the lower end. Thus, the springs 12 hold the arms 8 and hence the sharpening steels 9 in overlapping V-formation, the pins 6, 7 being so located that the point of the Vee lies on the longitudinal centre of the slot 4, towards its upper end.

On the insertion of a blade into the slot 4, and into contact with the steels 9, pressure on the steels causes the arms 8 to pivot about the pins 6, 7 against the action of the springs. The greater the pressure, the greater is the degree of penetration of the blade down the slot, and as the arms pivot, the narrower does the included angle of the Vee become. Thus, a blade can be inserted down the slot to an extent to suit its thickness, and create a V-angle between the steels that will re-sharpen the blade with the correct V-angle on its cutting edge. In this position, and with the housing held steady by the handle, the blade can be reciprocated across the steels to effect correct resharpening.

The push fit arrangement of the pins 6, 7 may be such that they can be disconnected to allow removal of the arms 8 should the sharpening steels 9 require replacement, although if relatively frequent replacement is envisaged, the pins 6, 7 may be replaced by suitable screws which can be removed with relatively greater ease.

I claim:

1. A sharpener for blades having a cutting edge comprising two sharpening elements mounted in overlaping V-formation and spring-loaded to each other, said sharpening elements being pivotally mounted at one end such that on pivotal movement of the sharpening elements consequent upon the application of a blade between the sharpening elements, the V-angle between the elements varies dependent upon the depth of insertion of the blades, said two sharpening elements each being of circular cross-section and each being mounted on a respective pivotally mounted arm to be freely rotatable on the respective arm.

2. A sharpener for blades having a cutting edge comprising two sharpening elements mounted in overlapping V-formation and spring-loaded to each other, said sharpening elements being pivotally mounted at one end such that on pivotal movement of the sharpening elements consequent upon the application of a blade between the sharpening elements, the V-angle between the elements varies dependent upon the depth of insertion of the blade, said two sharpening elements each being of circular cross-section and each being mounted on a respective pivotally mounted arm to be freely rotatable on the respective arm, and there being provided wear inserts at the ends of the said arms and in which the said sharpening elements are rotatably located.

* * * * *